US012312924B2

(12) United States Patent
Yang et al.

(10) Patent No.: US 12,312,924 B2
(45) Date of Patent: May 27, 2025

(54) SHAPED CHARGE LOAD TUBE WITH INTEGRATED DETONATION CORD RETENTION MECHANISM

(71) Applicant: GEODYNAMICS, INC., Millsap, TX (US)

(72) Inventors: Wenbo Yang, Kennedale, TX (US); James A. Rollins, Lipan, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 18/487,582

(22) Filed: Oct. 16, 2023

(65) Prior Publication Data

US 2024/0060401 A1 Feb. 22, 2024

Related U.S. Application Data

(63) Continuation of application No. 17/315,922, filed on May 10, 2021, now Pat. No. 11,834,935.

(60) Provisional application No. 63/022,909, filed on May 11, 2020.

(51) Int. Cl.
*E21B 43/1185* (2006.01)
*F42D 1/04* (2006.01)
*F42D 1/22* (2006.01)

(52) U.S. Cl.
CPC ..... *E21B 43/1185* (2013.01); *F42D 1/043* (2013.01); *F42D 1/22* (2013.01)

(58) Field of Classification Search
CPC .. E21B 43/1185; E21B 43/116; E21B 43/117; F42D 1/043; F42D 1/22
USPC ..... 89/1.15; 102/310, 312, 317
See application file for complete search history.

(56) References Cited

U.S. PATENT DOCUMENTS 3,048,101 A * 8/1962 Lebourg ..... E21B 43/117 175/4.6
3,048,103 A * 8/1962 Blair, Jr. ..... F42D 1/06 102/318
5,007,486 A * 4/1991 Ricles ..... E21B 43/117 175/4.6
6,439,121 B1 * 8/2002 Gillingham ..... C06C 5/06 102/275.12
7,942,098 B2 * 5/2011 Han ..... F42D 3/04 102/320
10,174,595 B2 * 1/2019 Knight ..... E21B 43/1185
10,422,195 B2 * 9/2019 LaGrange ..... E21B 43/119
2005/0211467 A1 * 9/2005 Ratanasirigulchia ..... E21B 43/119 102/321
2016/0290084 A1 * 10/2016 LaGrange ..... E21B 43/119
(Continued)

*Primary Examiner* — John Cooper
(74) *Attorney, Agent, or Firm* — Morgan, Lewis & Bockius LLP

(57) ABSTRACT

A loading tube is configured to receive one or more shaped charges to form a perforating gun. The loading tube includes a tubular body extending along a longitudinal axis; a cord passage formed into the tubular body; a retention cutoff formed into the tubular body and configured to receive a detonator cord; and a holding element extending into the retention cutoff and being integrally made with a wall of the tubular body, wherein the holding element is configured to hold the detonator cord into the retention cutoff. The cord passage is configured to receive the detonator cord from a bore of the tubular body and to direct the detonator cord outside the bore of the tubular body.

7 Claims, 8 Drawing Sheets

(56) References Cited

U.S. PATENT DOCUMENTS

| | | | | |
|---|---|---|---|---|
| 2017/0199015 | A1* | 7/2017 | Collins | F42B 1/02 |
| 2019/0195054 | A1* | 6/2019 | Bradley | F42D 1/04 |

* cited by examiner

SHAPED CHARGE LOAD TUBE WITH INTEGRATED DETONATION CORD RETENTION MECHANISM

BACKGROUND

Technical Field

Embodiments of the subject matter disclosed herein generally relate to shaped charges placed inside of a gun for making perforations into a casing of a well, and more specifically, to a detonation cord retention mechanism integrated into a loading tube, which is used with the shaped charges, inside the gun.

Discussion of the Background

In the oil and gas field, once a well is drilled to a desired depth H relative to the surface, and the casing protecting the wellbore has been installed and cemented in place, it is time to connect the wellbore to the subterranean formation to extract the oil and/or gas. This process of connecting the wellbore to the subterranean formation may include a step of plugging a previously fractured stage of the well with a plug, a step of perforating a portion of the casing, corresponding to a new stage, with a perforating gun string such that various channels are formed to connect the subterranean formation to the inside of the casing, a step of removing the perforating gun string, and a step of fracturing the various channels of the new stage. These steps are repeated until all the stages of the formation are fractured.

During the perforating step for a given stage, perforating guns of the perforating gun string are used to create perforation clusters in the multistage hydraulically fractured unconventional well. Clusters are typically spaced along the length of a stage (a portion of the casing that is separated with plugs from the other portions of the casing), and each cluster comprises multiple perforations (or holes). Each cluster is intended to function as a point of contact between the wellbore and the formation. After each stage is perforated, a slurry of proppant (sand) and liquid (water) is pumped into the stage at high rates and then, through the perforation holes, into the formation, with the intent of hydraulically fracturing the formation to increase the contact area between that stage and the formation. A typical design goal is for each of the clusters to take a proportional share of the slurry volume, and to generate effective fractures, or contact points, with the formation, so that the well produces a consistent amount of oil cluster to cluster and stage to stage.

A gun string 100 is illustrated in FIG. 1 and includes a first gun 110, a second gun 120, and a connecting sub 110, which is configured to connect the first gun to the second gun. Each gun includes at least one shaped charge. A gun string can include many guns, but for simplicity, FIG. 1 illustrates only two guns. The embodiment shown in FIG. 1 illustrates the first gun 110 having three shaped charges 112-1 to 112-3. The shaped charges are located inside a loading tube 114, which sits inside the casing 116 of the gun 110. Both the casing 116 and the loading tube 114 have a tubular configuration (for example, cylindrical), each having a corresponding bore. The shaped charges 112-1 to 112-3 are placed within a tubular body 115 of the loading tube 114 and then a detonator cord 118 is placed to ballistically connect each back end of the shaped charges to each other so that the fire power from one end of the detonator cord is sequentially propagated to each shaped charge. The loading tube with the shaped charges ballistically connected to each other are then inserted (slide) into the casing 116. Various mechanisms can be used to fix the loading tube relative to the casing of the gun.

After the loading tube is placed inside the casing, the space between the two elements is so small (mm to cm) so that no access can be provided to the shaped charges. The space inside the loading tube is similarly small (mm to a couple of cm) so that access to the shaped charges is also difficult. Thus, there are various ways for adding the shaped charges and the detonator cord to the loading tube prior to loading the casing with the loading tube. One such example is discussed in U.S. Pat. No. 7,942,098, and uses a trench formed in the outside of the loading tube for placing the detonator cord prior to assembly of the gun string. However, such a mechanism does not guarantee that the detonation cord would stay inside the trench and during the assembly process it is possible to have the detonation cord separating from one or more shaped charges, which would result in a misfire or failure to detonate the shaped charges. This is undesirable as the operator of the gun could not see that the detonation cord has been separated from the shaped charge, and also because a misfire alters the flow of the fracturing fluid inside the well during the fracturing stage.

Another method for attaching the detonation cord to the shaped charges is discussed in U.S. Pat. No. 10,488,163, and uses a retainer fitting for holding the detonation cord in place. The retainer fitting is a separately manufactured part that is added to the loading tube, and secured in place with various fastening means. In addition, precision holes need to be made into the loading tube to accommodate the retainer fitting. This is a cumbersome process that is labor intensive, which is not favored by the operator of the well.

Thus, there is a need for a new mechanism and method for quickly and effortlessly adding a detonation cord to a loading tube to ballistically connect one or more shaped charges.

SUMMARY

According to an embodiment, there is a loading tube configured to receive one or more shaped charges to form a perforating gun. The loading tube includes a tubular body extending along a longitudinal axis; a cord passage formed into the tubular body; a retention cutoff formed into the tubular body and configured to receive a detonator cord; and a holding element extending into the retention cutoff and being integrally made with a wall of the tubular body, wherein the holding element is configured to hold the detonator cord into the retention cutoff. The cord passage is configured to receive the detonator cord from a bore of the tubular body and to direct the detonator cord outside the bore of the tubular body.

According to another embodiment, there is a perforating gun for perforating a casing in a well. The perforating gun includes a casing extending along a longitudinal axis; a loading tube configured to fit inside a bore of the casing; plural shaped charges attached to the loading tube; and a detonation cord extending outside the loading tube and ballistically connecting the plural shaped charges. The loading tube includes a retention cutoff formed into a tubular body of the loading tube.

According to still another embodiment, there is a method for attaching a detonation cord to a loading tube of a perforating gun. The method includes adding plural shaped charges to a loading tube of a perforating gun; inserting one end of a detonator cord, from inside a bore of the loading tube, through a cord passage formed in a wall of the loading tube to arrive outside the loading tube; attaching the detonator cord to a tail of a shaped charge of the plural shaped charges; placing a portion of the detonation cord inside a retention cutoff formed into the wall of the loading tube, under a holding element; and attaching the detonator cord to another shaped charge of the plural shaped charges.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a perforating gun used for perforating a casing in a well. However, the embodiments discussed herein may be used for guns in another context.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a loading tube is configured to have, in addition to the charge holes that correspond to the shaped charges, one or more retention cutoffs for receiving the detonation cord. The one or more retention cutoffs may have any form and may include one or more holding elements (e.g., tabs or fingers or similar structures) for ensuring that the denotation cord is held in place, securely and safely, within the corresponding retention cutoff. Any number of retention cutoffs may be made in the loading tube and the charge holes of the shaped charges may be interleaved with the retention cutoffs according to any desired pattern in which the shaped charges are desired to be fired. In one embodiment, the retention cutoffs are formed flush with the external surface of the loading tube so that no part of the retention cutoffs protrudes outside the external surface. However, in another embodiment, the holding elements of the retention cutoffs may be shaped to protrude outside or inside of the external surface of the loading tube.

Figure 1:
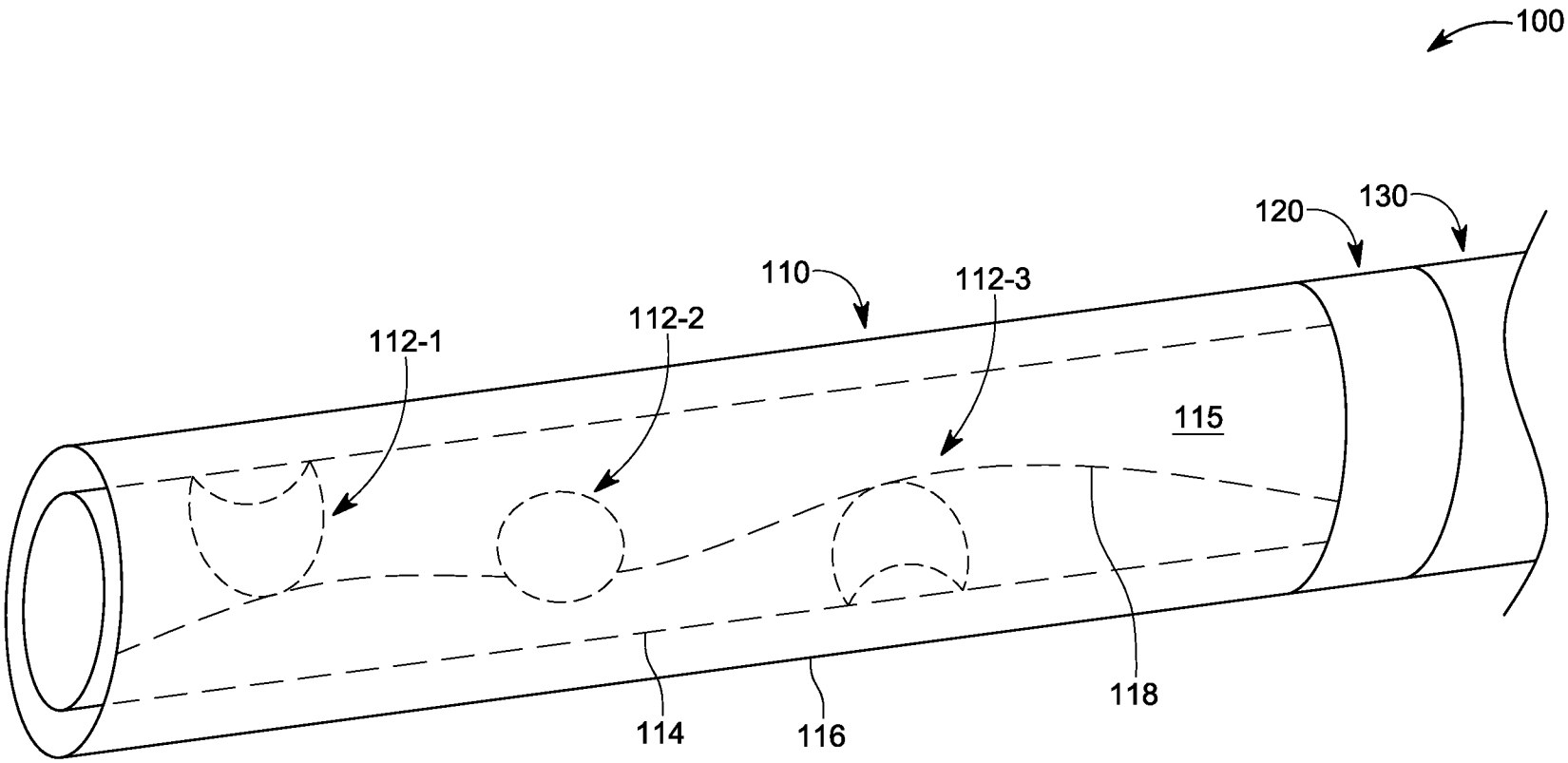
FIG. 1 illustrates a perforating gun having a casing and a loading tube, which is configured to host plural shaped charges.
Figure 2:
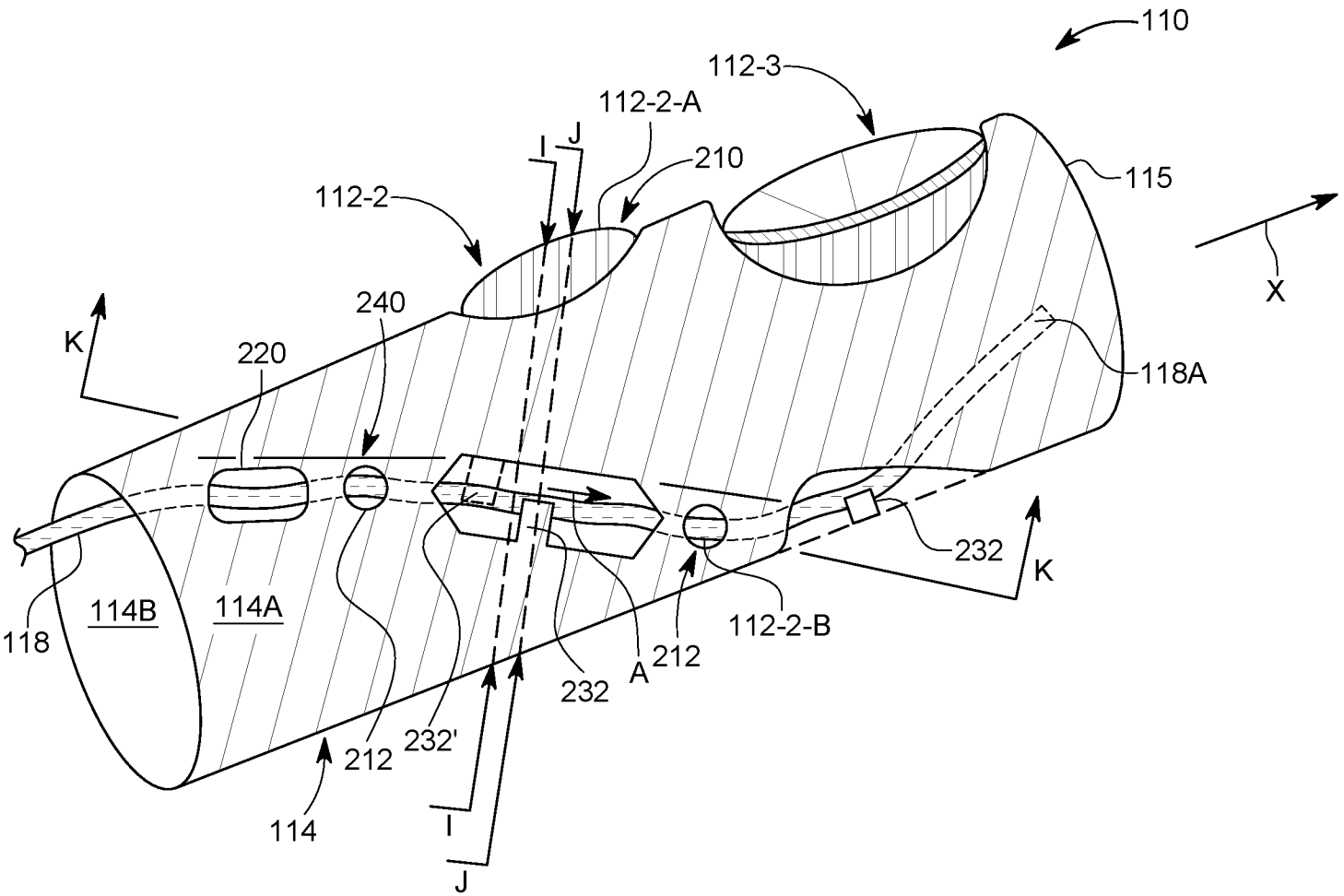
FIG. 2 illustrates the loading tube having a retention cutoff with a holding element for holding in place a detonation cord that connects the shaped charges.

More specifically, as shown in the embodiment of FIG. 2, the gun 110 is shown with the casing 116 removed, so that the loading tube 114, the shaped charges 112-2 and 112-3 and the detonation cord 118 are more clearly seen. Also missing in this figure is the first shaped charge 112-1, which would otherwise be located on the other side of the loading tube 114, which is not visible in the figure. Note that for each shaped charge, the loading tube 114 has a first shaped charge passage 210 (front passage) for accommodating the mouth (the largest end of the shaped charge) 112-2-A of the shaped charge 112-2 and a second shaped charge passage 212 (back passage) for accommodating the tail (the narrowest end of the shaped charge) 112-2-B of the shaped charge 112-2. This means that for each shaped charge, there are two diametrically opposite passages made into the loading tube 114. The loading tube 114 in this embodiment has a circular body 115. The detonator cord 118 needs to be attached to the tail end 112-2-B of the shaped charge. In this embodiment, the tail end of the shaped charge is shaped to protrude out of the exterior surface 114A of the loading tube 114, to be able to easily connect to the detonator cord 118. While the loading tube 114 in FIG. 2 shows passages for accommodating three shaped charges, one skilled in the art would know, based on this disclosure, that less or more shaped charges may be accommodated by a given loading tube. For example, in one embodiment, it is possible to have a single shaped charge.

FIG. 2 shows that the detonation cord 118 enters into the bore 114B of the loading tube 114 (see left hand side end) and then exits the bore 114B through a dedicate passage 220, called herein the "cord passage." From here on, the detonation cord 118 is wrapped outside the loading tube 114 until the last shaped charge of the loading tube is connected to the detonation cord. Thus, an end 118A of the detonation cord may be located outside the bore of the loading tube 114, after the last shaped charge of the gun. After exiting the bore of the loading tube 114 through the cord passage 220, the detonation cord 118 is wrapped to encounter the first shaped charge (missing in this figure for clarity) and physically connect to the tail end of the shaped charge. Note that although the first shaped charge 112-1 is missing in this figure, the corresponding back passage 212 formed in the loading tube 114 is shown, and the detonation cord 118 is placed just above the back passage 212.

Figure 3A:
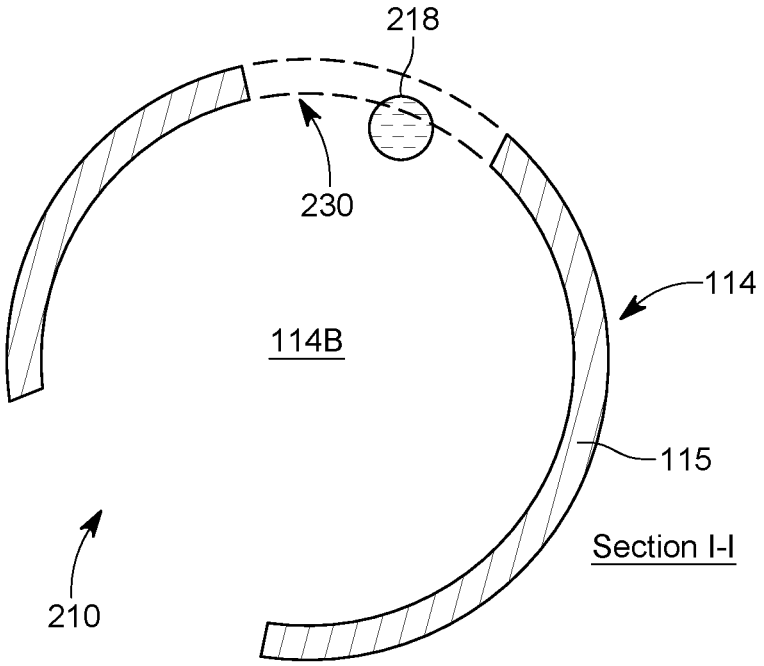
FIGS. 3A to 3C are various cross-sections through the loading tube of FIG. 2 to illustrate the retention cutoff and the holding element in various views.
Figure 3B:
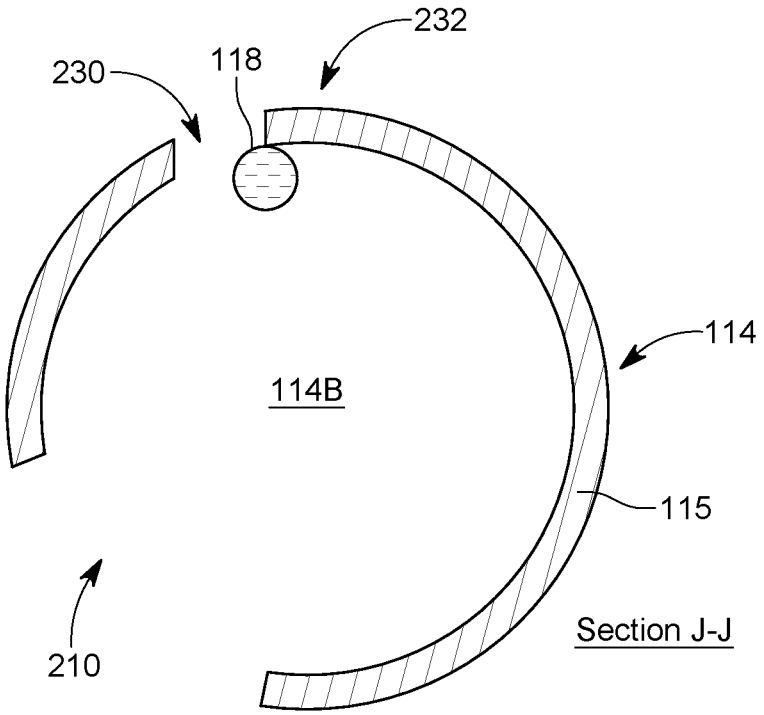
Figure 3C:
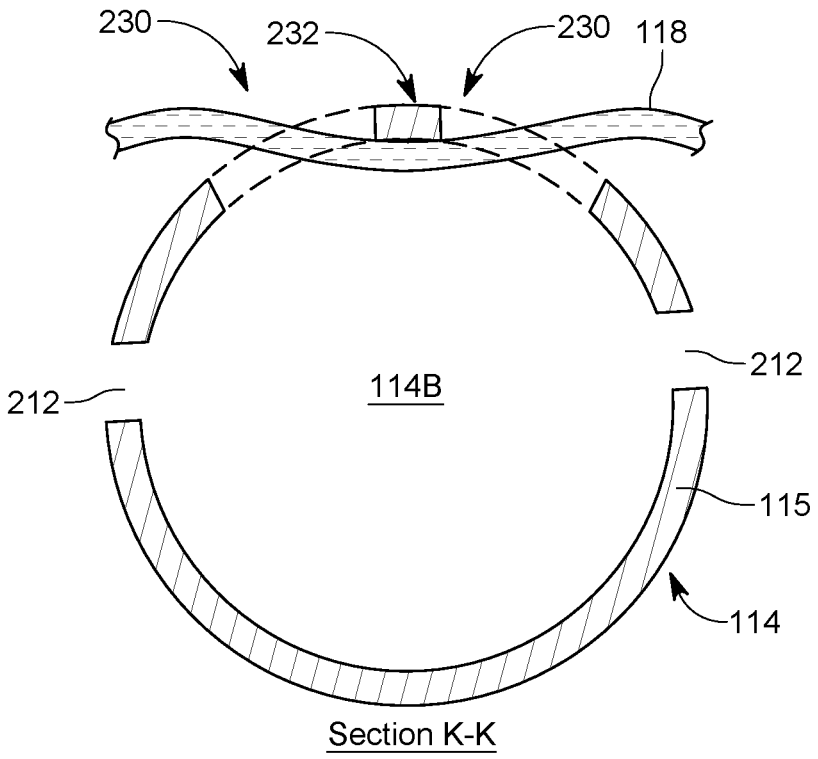

Next, the detonation cord 118 extends over a first retention cutoff 230, which in this embodiment is an actual cut made in the body 115 of the loading tube 114. The first retention cutoff 230 is shown having a single retention element 232, which is formed of the same material as the wall of the loading tube 114. In this embodiment, the retention element 232 is a tab that extends along a direction that is perpendicular to a longitudinal axis of the cutoff. The retention cutoff 230 is linear in this embodiment, i.e., its longitudinal sides are straight lines. More than one retention elements may be provided for a given retention cutoff and the figure indicates this possibility by showing with a dash line an additional possible retention element 232'. This means that no matter the material from which the body of the loading tube is made, e.g., metal or steel or steel alloy or composite, the retention cutoff 230 is a cut/passage into that material and the holding element is made of the same material as the holding tube 114. Due to this configuration, the detonation cord 118 can partially enter inside the bore 114B of the loading tube 114, as illustrated in FIG. 3A, which is a cross-section along line I-I of the loading tube 114 in FIG. 2. While FIG. 3A shows the detonation cord partially re-entering the bore 114B, in one embodiment it is possible that the detonation cord fully re-enters the bore 114B, but only in the region corresponding to the retention cutoff. FIG. 3B shows a cross-section along line J-J of the loading tube 114 in FIG. 2, and it is different from the cross-section in FIG. 3A because this cross-section is selected to show the holding element 232. Note that the detonation cord 118 in this figure is completely within the bore 114B, but only for the extent of the retention cutoff. The relationship between the holding element 232 and the detonation cord 118 is also shown in FIG. 3C, which corresponds to the cross-section along line K-K in FIG. 2, and it shows how the detonation cord enters the retention cutoff 230 and effectively the bore 114B, below the holding element 232, before exiting the retention cutoff and continuing outside the loading tube 114.

Figure 4:
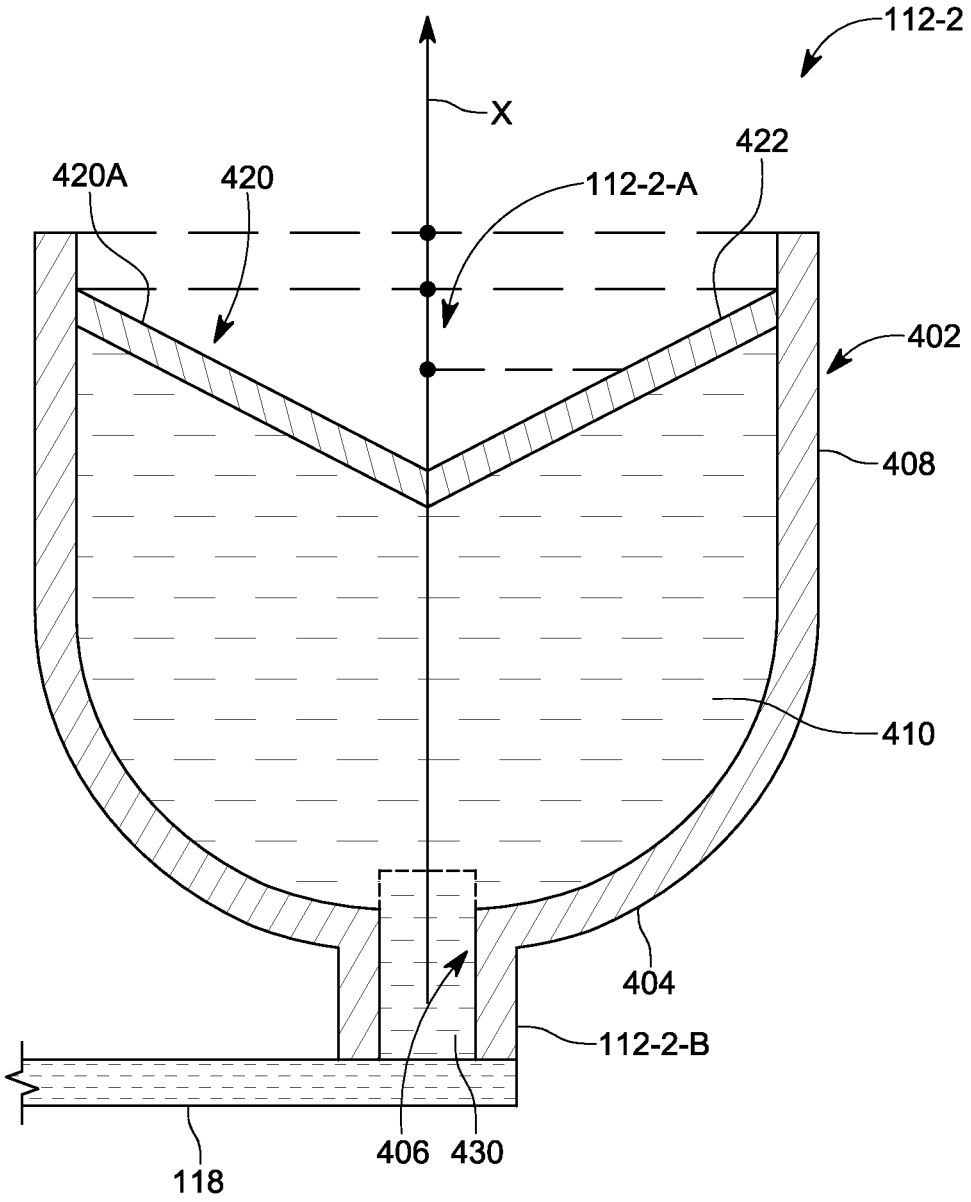
FIG. 4 is a schematic diagram of a shaped charge that is hosted by the loading tube.

For the context, FIG. 4 illustrates a shaped charge 112-2 that is placed inside the loading tube 114. The shaped charge 112-2 has a case 402 that may be made of any material that is strong enough to resist when the explosive material explodes. For example, the case may be made of steel or a metal. The case may take any shape, for example, conical, cylindrical, spherical, hemispherical, bell-shaped, parabolic or hyperboloid. FIG. 4 shows the case 402 having a cup shape, with a solid back wall 404 having a channel 406 in which the booster material 430 is located. The back wall 404 is also called herein a closed end. A pedestal 112-2-B, which is attached to the back wall 404 (made either integrally or separately of the pedestal) is used to attach the shaped charge to the loading tube 114 in the gun 110 and affix the detonation cord 118. The channel 406 may extend through the pedestal 405, along the symmetry axis X. The back wall 404 continues with a side wall 408 that is shaped as a cup. A top 112-2-A of the case 402 is open. For this reason, this part of the case is called an open end.

An explosive material 410 is placed inside the cup shaped case 402. The explosive material 410 is typically packed inside the case 402 by micro-forging or other methods. The explosive material may be a high explosive material, like NONA, ONT, RDX, HMX, HNS, BRX, PETN, CL-20, HNIW, PYX, TATB, TNAZ, HNIW, or other known explosive. The liner 420 covers the explosive material 410 and keeps it inside the case 402. The liner 420 may be made of a reactive or an inert material, e.g., metal particles mixed with a light glue, so that the liner appears like a metallic sheet.

The booster material 430 is placed at the bottom of the case 402, in the channel 406. The booster material 430 is connected to the detonation cord 118, which initiates the detonation of the booster material 430. The booster material includes a detonation material, which may be the same as the explosive material 410 or different. When the gun is fired, the gun detonator is first detonated, which initiates the detonation cord 118. The detonation cord 118 initiates the booster material 430. The detonation of the booster material 430 starts the explosion of the explosive material 410. Thus, in the embodiment of FIG. 4, there is a single initiation point, at the interface between the booster material 430 and the explosive material 410. The explosive material 410 is then initiated, which generates a detonation wave. The detonation wave collapses the liner 420 and melts it at the same time, resulting in a jet of material, which is expelled from the case 402 through the open end 112-2-A with a high energy. If the arrangement of the elements shown in FIG. 4 is symmetrical relative to the longitudinal axis X (the terms "longitudinal axis X" and "symmetry axis X" are used herein interchangeably), then the jet has substantially a circular cross-section and would generate substantially a circular hole in the casing of the well.

Returning to FIG. 2, it is noted that the retention cutoff 230 has a rectilinear shape, i.e., the long sides of the cutoff are straight lines extending along a longitudinal axis A. Note that the longitudinal axis A of the cutoff is different from the longitudinal axis X of the loading tube 114. This is so because traditionally the shaped charges 112 are distributed along a helical path 240 around the tube 114. However, if the shaped charges arrangement is changed, the retention cutoffs would follow that new arrangement, and in that case, the orientation of the longitudinal axis A may be parallel to the orientation of the longitudinal axis X, or they may be perpendicular to each other. In one embodiment, the two axes A and X can make any angle.

Figure 5:
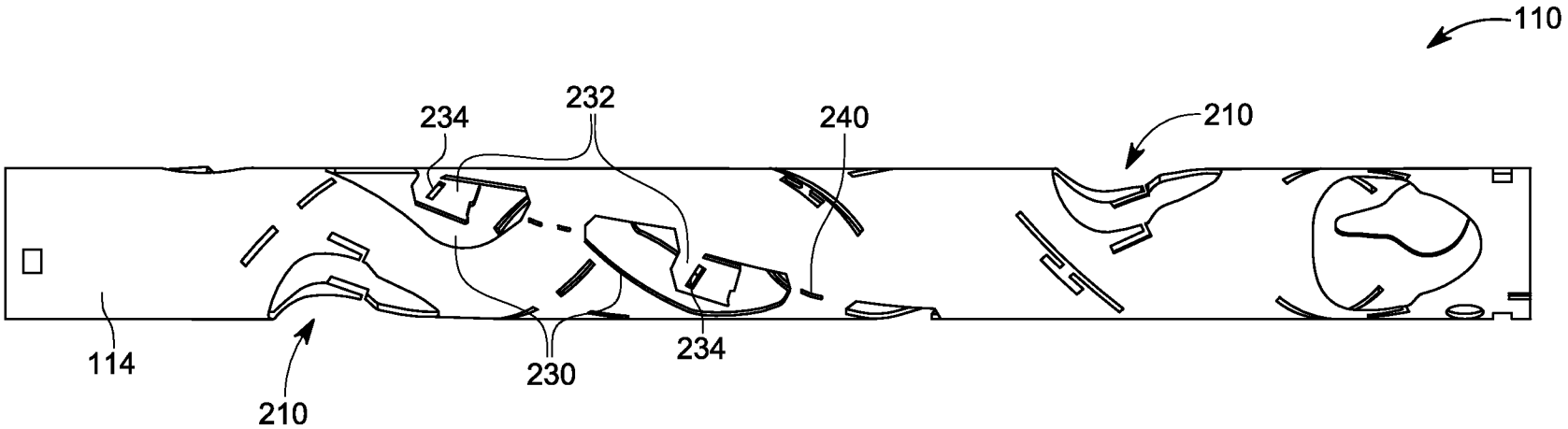
FIG. 5 illustrates the loading tube having irregular retention cutoffs with corresponding irregular holding elements.
Figure 6A:
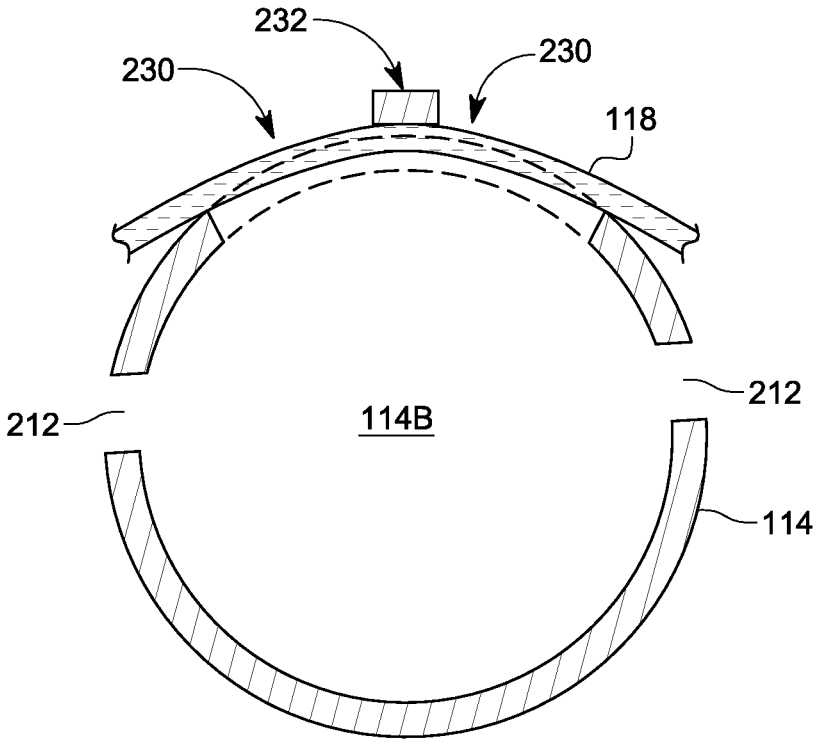
FIG. 6A illustrates the holding element being bent outward, to protrude out of the body of the loading tube.
Figure 6B:
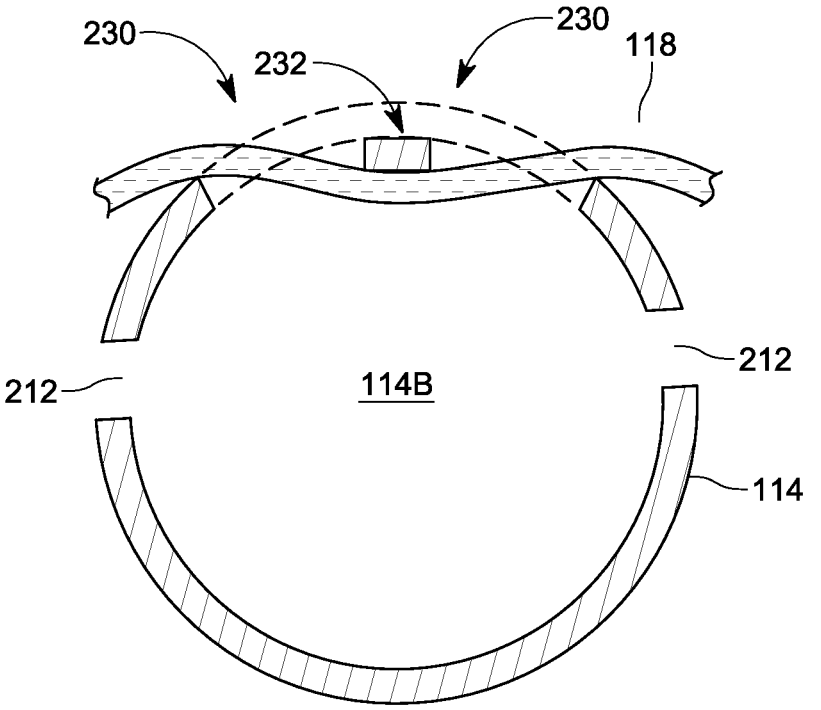
FIG. 6B illustrates the holding element being bent inward, to extend inside the bore of the loading tube.

In other embodiment, as illustrated in FIG. 5, the retention cutoff 230 is very irregular, i.e., it might have not straight edges. In this embodiment, the holding element 232 may also be made to have an irregular shape, as also shown in the figure. In one application, the holding element 232 may have a slot 234 that allows the operator of the gun to insert a dedicated tool (e.g., a screwdriver or a specially configured key tool) into the slot 234, and manually or automatically (using a robot for example) bend the holding element 232 toward the inside or outside of the bore 114B of the loading tube 114, for better accommodating the detonation cord 118. These possibilities are illustrated in FIGS. 6A and 6B, where FIG. 6A corresponds to the J-J cross-section of FIG. 2, and has the holding element 232 bent outward, away from the bore 114B of the loading tube 114, and FIG. 6B corresponds to the J-J cross-section of FIG. 2, and has the holding element 232 bent inward, inside the bore 114B of the loading tube 114. The dash lines in these figures indicate the circular contour of the body 115 of the loading tube 114.

FIG. 5 also shows that it is possible to have no back passage 212 between two consecutives retention cutoffs 230. Although FIG. 2 shows each retention cutoff 230 followed by a back passage 212, and this pattern is repeated along the helical path or helix 240, it is possible to have a number (2 or larger) of retention cutoffs adjacent to each other along the helical path, with no back passages 212 in between. As discussed above, the helical path can be also changed to be any path and along this path, any number of retention cutoffs can be distributed with no back passages 212 in between.

With these configurations, the detonator cord 118 can be installed almost entirely on the outside of the loading tube 118, with no need of using tape, or separate clips for securing it to the loading tube. In other words, with these configurations, no other element is used for securing the detonation cord to the loading tube except for the one or more of the retention cutoffs and one or more of the holding elements. Also, there is no need to making trenches or channels into the loading tube for accommodating the cord. In addition, according to these configurations, there is no need for machining a holder that is attached with screws or in other ways to the loading tube for holding the detonator cable. Furthermore, the configurations discussed herein do not require the addition of extra parts or material to the loading tube as the retention cutoffs and the holding elements are formed directly into and integrally with the body of the loading tube. In fact, by implementing the retention cutoffs as actual cuts into the wall of the body of the loading tube, this approach saves not only manufacturing time and material, but provides to the user of the gun an easy and quick way to attach the detonator cord to the exterior of the loading tube. In addition, this technology is appropriate for angled charges (see, for example, U.S. Pat. No. 9,725,993, which is owned by the assignee of this application), as the angled charges are under pressure to be dislodged from the loading tube. Thus, by placing these shaped charges to have the tail part in one passage of the loading tube, as illustrated in FIG. 2, prevents the dislodging of the shaped charges.

Figure 7:
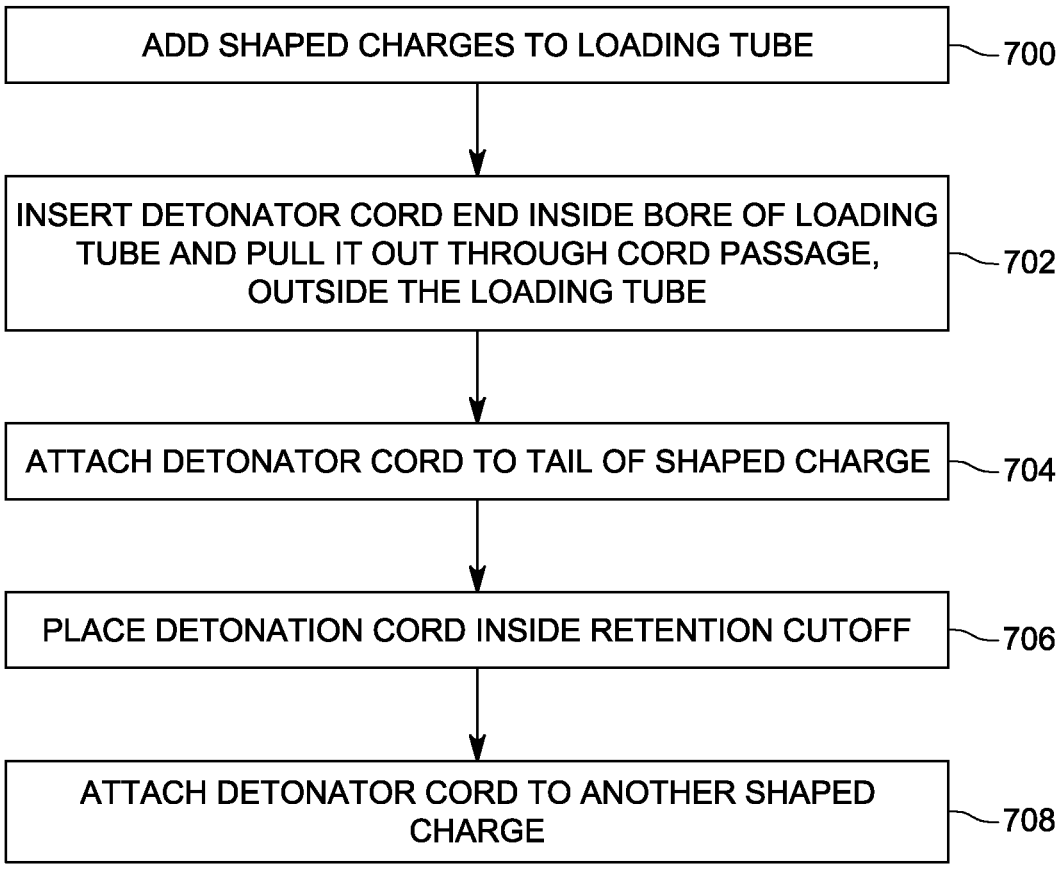
FIG. 7 is a flow chart of a method for securing a detonation cord to the loading tube using only the retention cutoffs.

A method for adding the detonator cord to one or more shaped charges present on a loading tube is now discussed with regard to FIG. 7. The method starts in step 700 by placing and securing the one or more shaped charges into corresponding passages formed in the loading tube. In step 702, an end of the detonator cord 118 is inserted inside the bore of the loading tube and then pulled out through a dedicated cord passage 220 made in the wall of the loading tube. Next, in step 704, the detonator cord is attached to a tail end 112-2-B of a first shaped charge 112-2. In step 706, the detonator cord is placed partially inside a retention cutoff 230 formed into the wall of the loading tube 114, under a holding element 232. This step can be performed anywhere along the detonation cord as the detonation cord slips under the holding element, into the retention cutoff. No special tool or device is needed for this step. In step 708, the detonator cord is attached to another tail end of a second shaped charge 112-3. Then, the process may be repeated for attaching the detonator cord to all the shaped charges of a given gun 110.

The disclosed embodiments provide methods and systems for adding a detonator cord to the exterior of a loading tube without the use of additional parts or materials except for the loading tube. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A perforating gun for perforating a casing in a well, the perforating gun comprising:

a casing extending along a longitudinal axis;

a loading tube configured to fit inside a bore of the casing;

plural shaped charges attached to the loading tube; and a detonation cord extending outside the loading tube and ballistically connecting the plural shaped charges, wherein the loading tube includes a retention cutoff formed into a tubular body of the loading tube, such that the detonation cord extends over the retention cutoff.

2. The perforating gun of claim 1, wherein the loading tube further comprises:

a holding element extending into the retention cutoff and being integrally made with a wall of the tubular body, wherein the holding element is configured to hold the detonator cord into the retention cutoff.

3. The perforating gun of claim 2, wherein the loading tube further comprises:

a cord passage formed into the wall of the loading tube, wherein the cord passage is configured to receive the detonator cord from a bore of the tubular body and to direct the detonator cord outside the bore of the tubular body.

4. The perforating gun of claim 1, wherein there are no other elements that hold the detonator cord attached to the tubular body.

5. The perforating gun of claim 1, wherein the loading tube further comprises:

a first shaped charge passage configured to receive a mouth of a corresponding shaped charge of the plural shaped charges; and a second shaped charge passage, configured to receive a tail of the corresponding shaped charge, wherein the second shaped charge passage has a diameter smaller than the first shaped charge passage.

6. The perforating gun of claim 5, further comprising:

another retention cutoff formed into the tubular body and configured to receive the detonator cord; and another holding element extending into the another retention cutoff and being integrally made with the wall of the tubular body, wherein the another holding element is configured to hold the detonator cord into the another retention cutoff.

7. The perforating gun of claim 6, wherein the retention cutoff, the second shaped charge passage, and the another retention cutoff are distributed along a helix on an outside of the loading tube.

* * * * *